US009951775B2

(12) United States Patent
Katayama et al.

(10) Patent No.: US 9,951,775 B2
(45) Date of Patent: Apr. 24, 2018

(54) ROTARY COMPRESSOR

(71) Applicant: FUJITSU GENERAL LIMITED, Kawasaki-shi, Kanagawa (JP)

(72) Inventors: Hiroki Katayama, Kanagawa (JP); Taku Morishita, Kanagawa (JP); Motonobu Furukawa, Kanagawa (JP); Naoya Morozumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 63 days.

(21) Appl. No.: 15/259,498

(22) Filed: Sep. 8, 2016

(65) Prior Publication Data

US 2017/0074269 A1 Mar. 16, 2017

(30) Foreign Application Priority Data

Sep. 11, 2015 (JP) ..... 2015-179641
Jul. 12, 2016 (JP) ..... 2016-137898

(51) Int. Cl.
*F03C 2/00* (2006.01)
*F03C 4/00* (2006.01)
(Continued)

(52) U.S. Cl.
CPC ..... *F04C 29/066* (2013.01); *F04C 18/3562* (2013.01); *F04C 18/3564* (2013.01);
(Continued)

(58) Field of Classification Search
CPC .. F04C 23/001; F04C 23/008; F04C 18/3562; F04C 18/3564; F04C 29/0057;
(Continued)

(56) References Cited

U.S. PATENT DOCUMENTS 5,035,050 A * 7/1991 Cowen ..... F04C 23/008 418/15
5,322,424 A * 6/1994 Fujio ..... F04C 23/001 418/11
(Continued)

FOREIGN PATENT DOCUMENTS

EP 1908958 A2 4/2008
EP 2372083 A1 10/2011
(Continued)

OTHER PUBLICATIONS

Extended European Search Report issued in corresponding EP Patent Application No. 16187919.2, dated Feb. 16, 2017.

*Primary Examiner* — Theresa Trieu
(74) *Attorney, Agent, or Firm* — McDermott Will & Emery LLP

(57) ABSTRACT

On a plane orthogonal to the rotation shaft, an upper muffler chamber has a plurality of flared portions that are flared from a center of a rotation shaft toward between penetrating bolts and a plurality of small-diameter portions that connect between the flared portions, are apart from penetrating bolts, and are formed on a center side of the rotation shaft from the penetrating bolts. A muffler outlet is provided in each flared portion. A second outlet and a refrigerant path hole of an upper end plate are positioned on an inside of one of a plurality of flared portions, and an opening area of the muffler outlet of one flared portion is greater than an opening area of the muffler outlet of each of the other flared portions.

3 Claims, 10 Drawing Sheets

(51) Int. Cl.

| | |
|---|---|
| ***F04C 2/00*** | (2006.01) |
| ***F04C 11/00*** | (2006.01) |
| ***F04C 29/06*** | (2006.01) |
| ***F04C 18/356*** | (2006.01) |
| ***F04C 29/00*** | (2006.01) |
| ***F04C 29/12*** | (2006.01) |
| ***F04C 23/00*** | (2006.01) |

(52) U.S. Cl.
CPC ..... *F04C 23/001* (2013.01); *F04C 29/0057* (2013.01); *F04C 29/0085* (2013.01); *F04C 29/065* (2013.01); *F04C 29/068* (2013.01); *F04C 29/12* (2013.01); *F04C 23/008* (2013.01); *F04C 2210/26* (2013.01); *F04C 2240/10* (2013.01); *F04C 2240/20* (2013.01); *F04C 2240/40* (2013.01); *F04C 2250/102* (2013.01); *F04C 2270/14* (2013.01)

(58) Field of Classification Search
CPC .. F04C 29/0085; F04C 29/065; F04C 29/066; F04C 29/068; F04C 29/12; F04C 2210/26; F04C 2240/10; F04C 2240/20; F04C 2240/40; F04C 2250/102; F04C 2270/14
USPC ..... 418/11, 58, 60, 63, 209–210, 270
See application file for complete search history.

(56) References Cited

U.S. PATENT DOCUMENTS

| | | | | |
|---|---|---|---|---|
| 8,469,679 | B2 * | 6/2013 | Ogasawara ..... | F04C 23/001 417/902 |
| 8,979,517 | B2 * | 3/2015 | Omura ..... | F04C 23/001 418/11 |
| 2006/0171835 | A1 | 8/2006 | Dreiman et al. | |
| 2010/0226796 | A1 * | 9/2010 | Kanayama ..... | F04C 23/008 417/410.3 |
| 2014/0322057 | A1 * | 10/2014 | Ogata ..... | F04C 23/001 418/11 |

FOREIGN PATENT DOCUMENTS

| | | | |
|---|---|---|---|
| JP | 2000-320479 | A | 11/2000 |
| JP | 2001-280241 | A | 10/2001 |
| JP | 4911147 | B2 | 4/2012 |
| WO | 2013/168194 | A1 | 11/2013 |

* cited by examiner

ROTARY COMPRESSOR

CROSS-REFERENCE TO RELATED APPLICATIONS

The present application claims priority from Japanese Patent application JP 2015-179641, filed on Sep. 11, 2015, and Japanese Patent application JP 2016-137898, filed on Jul. 12, 2016, the contents of which are hereby incorporated by reference into this application.

FIELD

The present invention relates to a rotary compressor that is used in an air conditioner, a refrigerating machine, or the like.

BACKGROUND

For a purpose of suppressing noise caused by discharge of refrigerant, for example, a muffler member, in which two muffler outlets provided in the muffler member (end plate cover) are disposed in positions which are symmetrical sound sources with respect to an space on an outside of the muffler and nodes of a primary resonant mode and a flared portion of the muffler in a radial direction is an asymmetrical shape with respect to a y axis orthogonal to a rotation shaft, thereby being shifted from a position of a belly of a secondary resonant mode, is known.

As the related art, there is a configuration in which for a purpose of avoiding the positions of the bellies of the primary resonant mode and the secondary resonant mode, a muffler outlet is disposed adjacent to an outer peripheral portion of the boss portion (main bearing) of a front head (upper end plate). However, in such a configuration, in a case of a rotary compressor of a two-cylinder type, it becomes a muffler structure in which refrigerant that is compressed in a second compressing unit and refrigerant having a different pressure pulsation component, which is compressed in a first compressing unit and of which a pressure pulsation is reduced by a first muffler and a refrigerant path are easy to merge in a second muffler space. Therefore, the pressure pulsation is amplified and, as a result, there is a problem that noise is increased.

An object of the invention is to obtain a rotary compressor which suppresses a pressure pulsation of refrigerant being amplified and is able to suppress noise caused by discharge of refrigerant.

DETAILED DESCRIPTION

Hereinafter, an example (exemplary embodiment) for embodying the invention will be described in detail based on the drawings.

EXAMPLE 1

Figure 1:
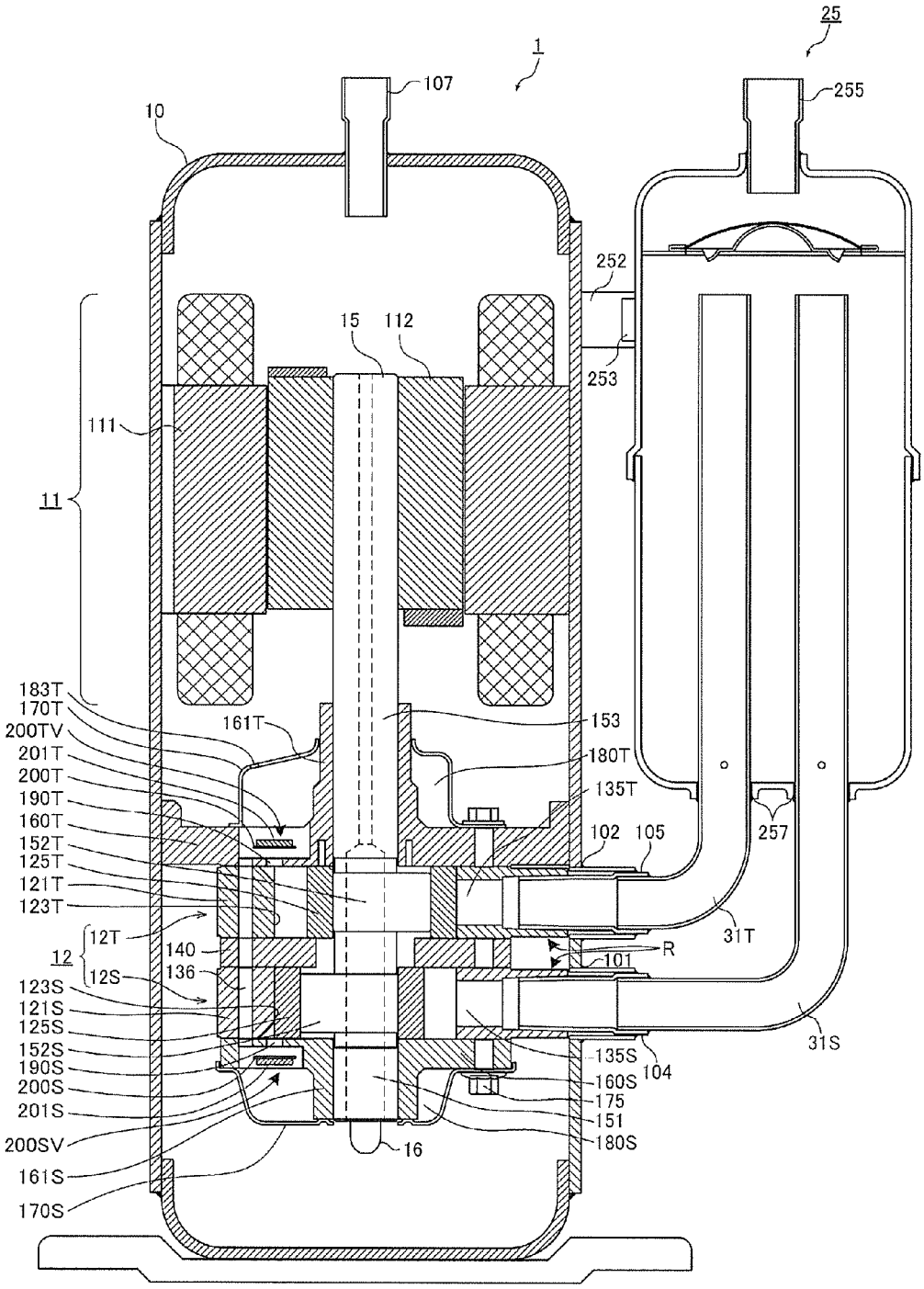
FIG. 1 is a vertical sectional view illustrating a rotary compressor according to an example of the invention.
Figure 2:
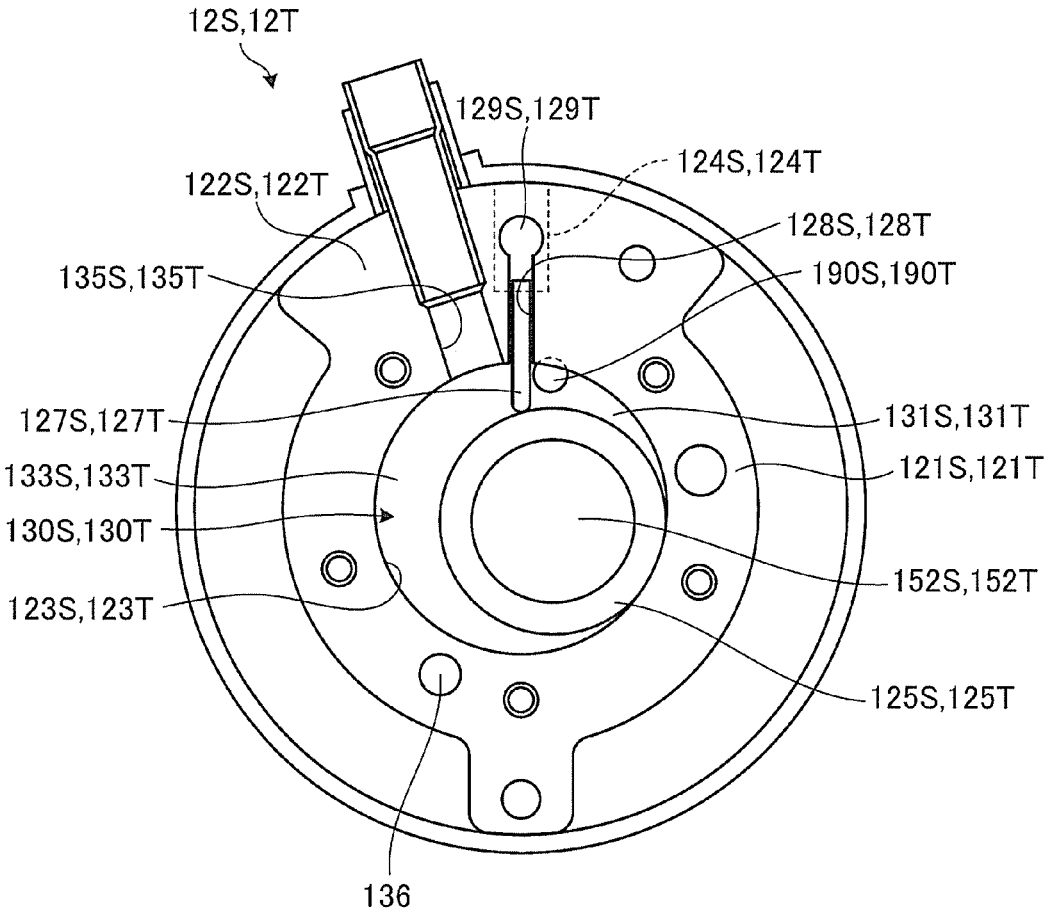
FIG. 2 is a horizontal sectional view of a first compressing unit and a second compressing unit of the example when viewed from below.

FIG. 1 is a vertical sectional view illustrating an example of a rotary compressor according to the invention. FIG. 2 is a horizontal sectional view of a first compressing unit and a second compressing unit of the example when viewed from below.

As illustrated in FIG. 1, a rotary compressor 1 of the example includes a compressing unit 12 that is disposed in a lower section of a vertically-positioned airtight compressor housing 10 which has a cylindrical shape, and a motor 11 that is disposed in an upper section of the compressor housing 10 and drives the compressing unit 12 via a rotation shaft 15.

A stator 111 of the motor 11 is formed in a cylindrical shape and is shrink-fitted and fixed in the inner circumferential surface of the compressor housing 10. A rotor 112 of the motor 11 is disposed inside the cylindrical stator 111 and is shrink-fitted and fixed to the rotation shaft 15 that mechanically connects the motor 11 with the compressing unit 12.

The compressing unit 12 includes a first compressing unit 12S and a second compressing unit 12T, and the second compressing unit 12T is disposed on an upper side of the first compressing unit 12S. As illustrated in FIG. 2, the first compressing unit 12S includes an annular first cylinder 121S. The first cylinder 121S has a first side-flared portion 122S that is flared from an annular outer periphery in a radial direction of the rotation shaft 15. A first inlet hole 135S and a first vane groove 128S are radially provided in the first side-flared portion 122S. In addition, the second compressing unit 12T includes an annular second cylinder 121T. The second cylinder 121T has a second side-flared portion 122T that is flared from the annular outer periphery in the radial direction of the rotation shaft 15. A second inlet hole 135T and a second vane groove 128T are radially provided in the second side-flared portion 122T.

As illustrated in FIG. 2, a circular first cylinder inner wall 123S is formed in the first cylinder 121S concentric to the rotation shaft 15 of the motor 11. An annular first piston 125S of which an outer diameter is smaller than an inner diameter of the first cylinder 121S is disposed within the first cylinder inner wall 123S. A first cylinder chamber 130S, which sucks a refrigerant, compresses a refrigerant, and discharges a refrigerant, is formed between the first cylinder inner wall 123S and the first piston 125S. A circular second cylinder inner wall 123T is formed in the second cylinder 121T concentric to the rotation shaft 15 of the motor 11. An annular second piston 125T of which an outer diameter is smaller than an inner diameter of the second cylinder 121T is disposed within the second cylinder inner wall 123T. A second cylinder chamber 130T, which sucks the refrigerant, compresses the refrigerant, and discharges the refrigerant, is formed between the second cylinder inner wall 123T and the second piston 125T.

The first vane groove 128S is formed in the first cylinder 121S over an entire region of a cylinder height in a radial direction from the first cylinder inner wall 123S. A planar first vane 127S is slidably fitted into the first vane groove 128S. The second vane groove 128T is formed in the second cylinder 121T over an entire region of a cylinder height in a radial direction from the second cylinder inner wall 123T. A planar second vane 127T is slidably fitted into the second vane groove 128T.

As illustrated in FIG. 2, a first spring bore 124S is formed on an outside of the first vane groove 128S in the radial direction so as to communicate with the first vane groove 128S from an outer periphery of the first side-flared portion 122S. A first vane spring (not illustrated), which presses a rear surface of the first vane 127S, is inserted into the first spring bore 124S. A second spring bore 124T is formed on an outside of the second vane groove 128T in the radial direction so as to communicate with the second vane groove 128T from an outer periphery of the second side-flared portion 122T. A second vane spring (not illustrated), which presses a rear surface of the second vane 127T, is inserted into the second spring bore 124T.

When the rotary compressor 1 is started, the first vane 127S protrudes from the inside of the first vane groove 128S to the inside of the first cylinder chamber 130S by a repulsive force of the first vane spring and a distal end thereof abuts against an outer peripheral surface of the annular first piston 125S. As a result, the first cylinder chamber 130S is partitioned to a first inlet chamber 131S and a first compression chamber 133S by the first vane 127S. In addition, similarly, the second vane 127T protrudes from the inside of the second vane groove 128T to the inside of the second cylinder chamber 130T by a repulsive force of the second vane spring and a distal end thereof abuts against an outer peripheral surface of the annular second piston 125T. As a result, the second cylinder chamber 130T is partitioned to a second inlet chamber 131T and a second compression chamber 133T by the second vane 127T.

In addition, an outside of the first vane groove 128S in the radial direction communicates with the inside of the compressor housing 10 via an opening portion R (see FIG. 1) and thereby a compressed refrigerant within the compressor housing 10 is introduced into the first cylinder 121S. In this case, a first pressure guiding-in path 129S applying a back pressure by a pressure of the refrigerant is formed in the first vane 127S. Moreover, the compressed refrigerant within the compressor housing 10 is also introduced from the first spring bore 124S. In addition, an outside of the second vane groove 128T in the radial direction communicates with the inside of the compressor housing 10 via the opening portion R (see FIG. 1) and thereby a compressed refrigerant within the compressor housing 10 is introduced into the second cylinder 121T. In this case, a second pressure guiding-in path 129T applying a back pressure by the pressure of the refrigerant is formed in the second vane 127T. Moreover, the compressed refrigerant within the compressor housing 10 is also introduced from the second spring bore 124T.

For a purpose of sucking the refrigerant from the outside to the first inlet chamber 131S, the first inlet hole 135S that causes the first inlet chamber 131S to communicate with the outside is provided in the first side-flared portion 122S of the first cylinder 121S. For a purpose of sucking the refrigerant from the outside to the second inlet chamber 131T, the second inlet hole 135T that causes the second inlet chamber 131T to communicate with the outside is provided in the second side-flared portion 122T of the second cylinder 121T. A cross-section of each of the first inlet hole 135S and the second inlet hole 135T is circular.

In addition, as illustrated in FIG. 1, an intermediate partition plate 140 is disposed between the first cylinder 121S and the second cylinder 121T and partitions the first cylinder chamber 130S (see FIG. 2) of the first cylinder 121S and the second cylinder chamber 130T (see FIG. 2) of the second cylinder 121T. The intermediate partition plate 140 closes the upper end of the first cylinder 121S and the lower end of the second cylinder 121T.

A lower end plate 160S is disposed in a lower end portion of the first cylinder 121S and closes the first cylinder chamber 130S of the first cylinder 121S. In addition, an upper end plate 160T is disposed in an upper end portion of the second cylinder 121T and closes the second cylinder chamber 130T of the second cylinder 121T. The lower end plate 160S closes a lower end portion of the first cylinder 121S and the upper end plate 160T closes an upper end portion of the second cylinder 121T.

A sub-bearing unit 1615 is formed on the lower endplate 160S and a sub-shaft unit 151 of the rotation shaft 15 is rotatably supported in the sub-bearing unit 1615. A main-bearing unit 161T is formed on the upper end plate 160T and a main-shaft unit 153 of the rotation shaft 15 is rotatably supported in the main-bearing unit 161T.

The rotation shaft 15 includes a first eccentric portion 152S and a second eccentric portion 152T which are eccentric by 180° phase shift from each other. The first eccentric portion 152S is rotatably fit in the first piston 125S of the first compressing unit 12S. The second eccentric portion 152T is rotatably fit in the second piston 125T of the second compressing unit 12T.

If the rotation shaft 15 is rotated, the first piston 125S revolves in the counterclockwise direction of FIG. 2 within the first cylinder 121S along the first cylinder inner wall 123S and, accordingly, the first vane 127S reciprocates. Volumes of the first inlet chamber 131S and the first compression chamber 133S are continuously changed by the movement of the first piston 125S and the first vane 127S. The compressing unit 12 continuously sucks, compresses, and discharges the refrigerant. In addition, if the rotation shaft 15 is rotated, the second piston 125T revolves in the counterclockwise direction of FIG. 2 within the second cylinder 121T along the second cylinder inner wall 123T and, accordingly, the second vane 127T reciprocates. Volumes of the second inlet chamber 131T and the second compression chamber 133T are continuously changed by the movement of the second piston 125T and the second vane 127T. The compressing unit 12 continuously sucks, compresses, and discharges the refrigerant.

As illustrated in FIG. 1, a lower end plate cover 170S is disposed on the lower side of the lower end plate 160S and a lower muffler chamber 180S is formed between the lower end plate 160S and the lower end plate cover 170S. Then, the first compressing unit 12S opens to the lower muffler chamber 180S. That is, a first outlet 190S (see FIG. 2) through which the first compression chamber 133S of the first cylinder 121S communicates with the lower muffler chamber 180S is provided in the vicinity of the first vane 127S of the lower end plate 160S. In addition, a reed valve type first discharge valve 200S which prevents the compressed refrigerant from flowing backward is disposed in the first outlet 190S.

The lower muffler chamber 180S is a single chamber. The lower muffler chamber 180S is a part of a communication path through which a discharge side of the first compressing unit 12S communicates with the inside of the upper muffler chamber 180T by passing through a refrigerant path hole 136 (see FIG. 2) which penetrates the lower end plate 160S, the first cylinder 121S, the intermediate partition plate 140, the second cylinder 121T, and the upper end plate 160T. The lower muffler chamber 180S reduces the pressure pulsation of the discharge refrigerant discharged from the first cylinder chamber 130S. In addition, a first discharge valve cover 201S which controls an amount of flexural valve opening of the first discharge valve 200S is stacked on the first discharge valve 200S and is fixed to the first discharge valve 200S using a rivet. The first outlet 190S, the first discharge valve 200S, and the first discharge valve cover 201S configure a first discharge valve unit 200SV of the lower end plate 160S. The lower end plate 160S covers the lower ends of the first discharge valve unit 200SV and the refrigerant path hole 136.

As illustrated in FIG. 1, an upper end plate cover 170T is disposed on the upper side of the upper end plate 160T and an upper muffler chamber 180T is formed between the upper end plate 160T and the upper end plate cover 170T. A second outlet 190T (see FIG. 2) through which the second compression chamber 133T of the second cylinder 121T communicates with the upper muffler chamber 180T is provided in the vicinity of the second vane 127T of the upper end plate 160T. A reed valve type second discharge valve 200T which prevents the compressed refrigerant from flowing backward is disposed in the second outlet 190T. In addition, a second discharge valve cover 201T which controls an amount of flexural valve opening of the second discharge valve 200T is stacked on the second discharge valve 200T and is fixed using a rivet with the second discharge valve 200T. The upper muffler chamber 180T causes the pressure pulsation of the discharge refrigerant discharged from the second cylinder chamber 130T to be reduced. The second outlet 190T, the second discharge valve 200T, and the second discharge valve cover 201T configure a second discharge valve unit 200TV of the upper end plate 160T. The upper end plate 160T covers the upper ends of the second discharge valve unit 200TV and the refrigerant path hole 136 (details of the upper end plate cover 170T and the upper muffler chamber 180T will be described later).

The lower end plate cover 170S, the lower end plate 160S, the first cylinder 121S, and the intermediate partition plate 140 are inserted from the lower side and are fastened to the second cylinder 121T by a plurality (four or more) of penetrating bolts 175 that are screwed into female screws provided in the second cylinder 121T. The upper end plate cover 170T and the upper end plate 160T are inserted from the upper side and are fastened to the second cylinder 121T by the penetrating bolts 175 that are screwed into female screws provided in the second cylinder 121T. The lower end plate cover 170S, the lower end plate 160S, the first cylinder 121S, the intermediate partition plate 140, the second cylinder 121T, the upper end plate 160T, and the upper end plate cover 170T, which are integrally fastened by the plurality of penetrating bolts 175 and the like, configure the compressing unit 12. The outer periphery of the upper end plate 160T in the compressing unit 12 is joined to the inner peripheral surface of the compressor housing 10 by spot welding and the compressing unit 12 is fixed to the compressor housing 10.

First and second through holes 101 and 102 are provided in an outer periphery wall of the cylindrical compressor housing 10 at an interval in an axial direction in this order from a lower section thereof so as to communicate with first and second inlet pipes 104 and 105, respectively. In addition, outside the compressor housing 10, an accumulator 25 which is formed of a separate airtight cylindrical container is held by an accumulator holder 252 and an accumulator band 253.

A system connecting pipe 255 which is connected to an evaporator in a refrigerant circuit is connected at the center of the top portion of the accumulator 25. A first low-pressure communication tube 31S and a second low-pressure communication tube 31T are fixed to a bottom through hole 257 that is provided in a bottom portion of the accumulator 25. One ends of the first low-pressure communication tube 31S and the second low-pressure communication tube 31T are extended to an upper side on an inside of the accumulator 25. The other ends thereof are respectively connected to the other ends of the first inlet pipe 104 and the second inlet pipe 105.

The first low-pressure communication tube 31S, which guides a low-pressure refrigerant of the refrigerant circuit to the first compressing unit 12S via the accumulator 25, is connected to the first inlet hole 135S (see FIG. 2) of the first cylinder 121S via the first inlet pipe 104 as an inlet unit. In addition, the second low-pressure communication tube 31T, which guides the low-pressure refrigerant of the refrigerant circuit (refrigeration cycle) to the second compressing unit 12T via the accumulator 25, is connected to the second inlet hole 135T (see FIG. 2) of the second cylinder 121T via the second inlet pipe 105 as the inlet unit. That is, the first inlet hole 135S and the second inlet hole 135T are connected to the evaporator of the refrigerant circuit in parallel.

A discharge pipe 107 as a discharge unit, which is connected to the refrigerant circuit (refrigeration cycle) and discharges a high-pressure refrigerant to a side of a condenser in the refrigerant circuit, is connected to the top portion of the compressor housing 10. That is, the first and second outlets 190S and 190T are connected to the condenser in the refrigerant circuit.

Lubricant oil is sealed in the compressor housing 10 substantially to a height of the second cylinder 121T. In addition, the lubricant oil is sucked up from a lubricating pipe 16 attached to the lower end portion of the rotation shaft 15, using a pump impeller (not illustrated) which is inserted into the lower section of the rotation shaft 15. The lubricant oil circulates through the compressing unit 12, lubricates sliding components (the first piston 125S and the second piston 125T), and seals a fine gap in the compressing unit 12.

Figure 3:
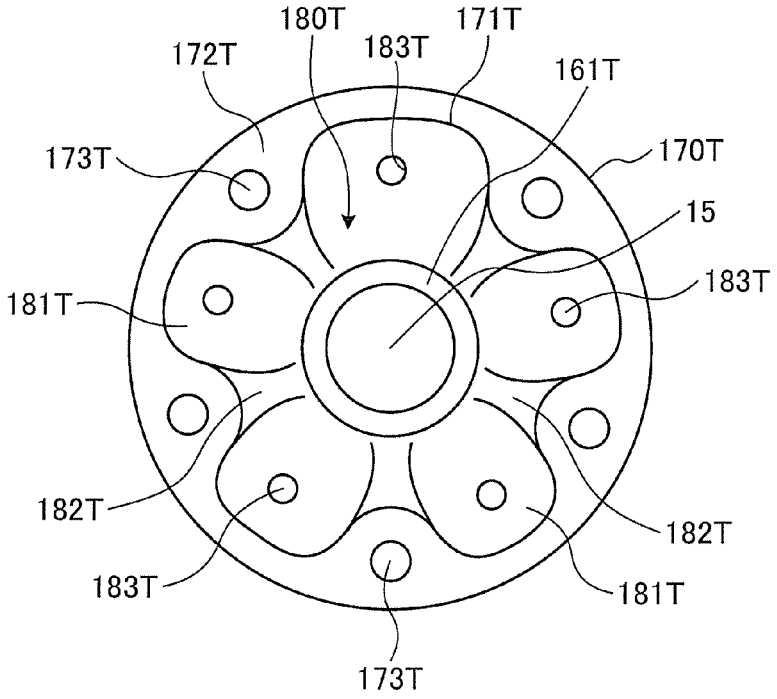
FIG. 3 is a plan view of an upper end plate cover of Example 1 when viewed from below.
Figure 4:
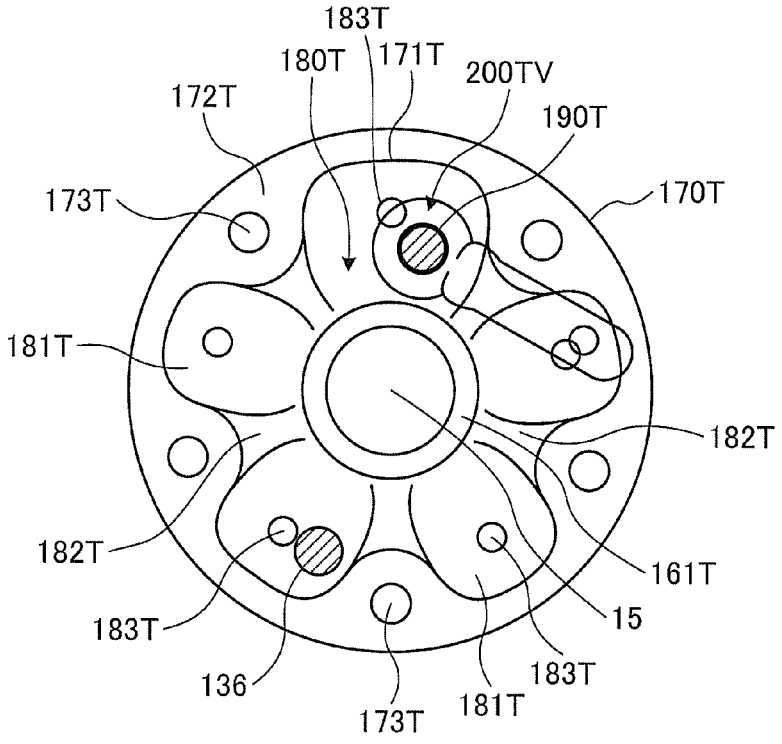
FIG. 4 is a plan view in which a positional relationship between the upper end plate cover, a discharge valve unit, and a refrigerant path hole of Example 1 are viewed from below the upper end plate cover.

Next, characteristic configurations of the rotary compressor 1 of Example 1 will be described with reference to FIGS. 3 and 4. FIG. 3 is a plan view of an upper end plate cover of Example 1 when viewed from below. FIG. 4 is a plan view of a positional relationship between the upper end plate cover, the discharge valve unit, and the refrigerant path hole when viewed below the upper end plate cover.

As illustrated in FIGS. 3 and 4, the upper end plate cover 170T of Example 1 is formed in a circular shape viewed in a plan view by press molding of steel plate and has a recessed portion 171T that is an outer shell of the upper muffler chamber 180T. Five bolt holes 173T through which the penetrating bolts 175 pass are disposed in a flat plate portion 172T configuring an outer edge of the upper end plate cover 170T. The upper end plate cover 170T, the upper end plate 160T, and the second cylinder 121T are fastened by five penetrating bolts 175.

The upper end plate cover 170T covers the upper ends of the second discharge valve unit 200TV and the refrigerant path hole 136 of the upper end plate 160T (see FIG. 4), and the upper muffler chamber 180T is formed between the upper end plate cover 170T and the upper end plate 160T. On a plane orthogonal to the rotation shaft 15, the upper muffler chamber 180T has five (plurality) flared portions 181T which are radially flared between the penetrating bolts 175 (bolt holes 173T) from the center of the rotation shaft 15; and five small-diameter portions 182T, which connect between the flared portions 181T respectively, are apart from the penetrating bolts 175 so as not to interfere with the penetrating bolts 175 (bolt holes 173T), and are formed on the center side of the rotation shaft 15 from the penetrating bolts 175.

A muffler outlet 183T is provided in each of the five flared portions 181T. The muffler outlet 183T causes the upper muffler chamber 180T to communicate with the inside of the compressor housing 10.

As illustrated in FIG. 4, the second outlet 190T configuring the second discharge valve unit 200TV and the refrigerant path hole 136 through which the lower muffler chamber 180S communicates with the upper muffler chamber 180T are opened toward the flared portion 181T of the upper muffler chamber 180T. The second outlet 190T and the refrigerant path hole 136 are disposed in positions on sides which are opposite to each other with respect to the rotation shaft 15. Moreover, a total opening area of five muffler outlets 183T is equal to or less than a total opening area of the first and second outlets 190S and 190T so as to reduce the pressure pulsation of the discharge refrigerant by filling the upper muffler chamber 180T with the discharge refrigerant discharged from the first and second outlets 190S and 190T.

In the rotary compressor 1 of Example 1, on the plane orthogonal to the rotation shaft 15, the upper muffler chamber 180T has a plurality of flared portions 181T which are radially flared between the penetrating bolts 175 (bolt holes 173T) from the center of the rotation shaft 15; and a plurality of small-diameter portions 182T, which connect between the flared portions 181T respectively, are apart from the penetrating bolts 175 so as not to interfere with the penetrating bolts 175 (bolt holes 173T), and are formed on the center side of the rotation shaft 15 from the penetrating bolts 175.

The muffler outlet 183T is provided in each of the plurality of flared portions 181T. The second outlet 190T of the second discharge valve unit 200TV of the upper end plate 160T and the refrigerant path hole 136 which are opened on the inside of the upper muffler chamber 180T are disposed in the flared portions 181T on sides which are opposite to each other with respect to the rotation shaft 15. Therefore, the refrigerant discharged from the second outlet 190T is discharged from the muffler outlet 183T disposed on the second outlet 190T side to the inside of the compressor housing 10. The refrigerant discharged from the refrigerant path hole 136 is discharged from the muffler outlet 183T disposed on the refrigerant path hole 136 side to the inside of the compressor housing 10.

Therefore, the refrigerant that is compressed by the second compressing unit 12T and the refrigerant having different pulsation component, which is compressed by the first compressing unit 12S, of which the pressure pulsation is reduced by the lower muffler chamber 180S and the refrigerant path hole 136 are unlikely to be merged on the inside of the upper muffler chamber 180T. Therefore, it is suppressed that the pressure pulsation of the refrigerant is amplified and it is possible to suppress an increase in noise caused by the amplification of the pressure pulsation.

Figure 5:
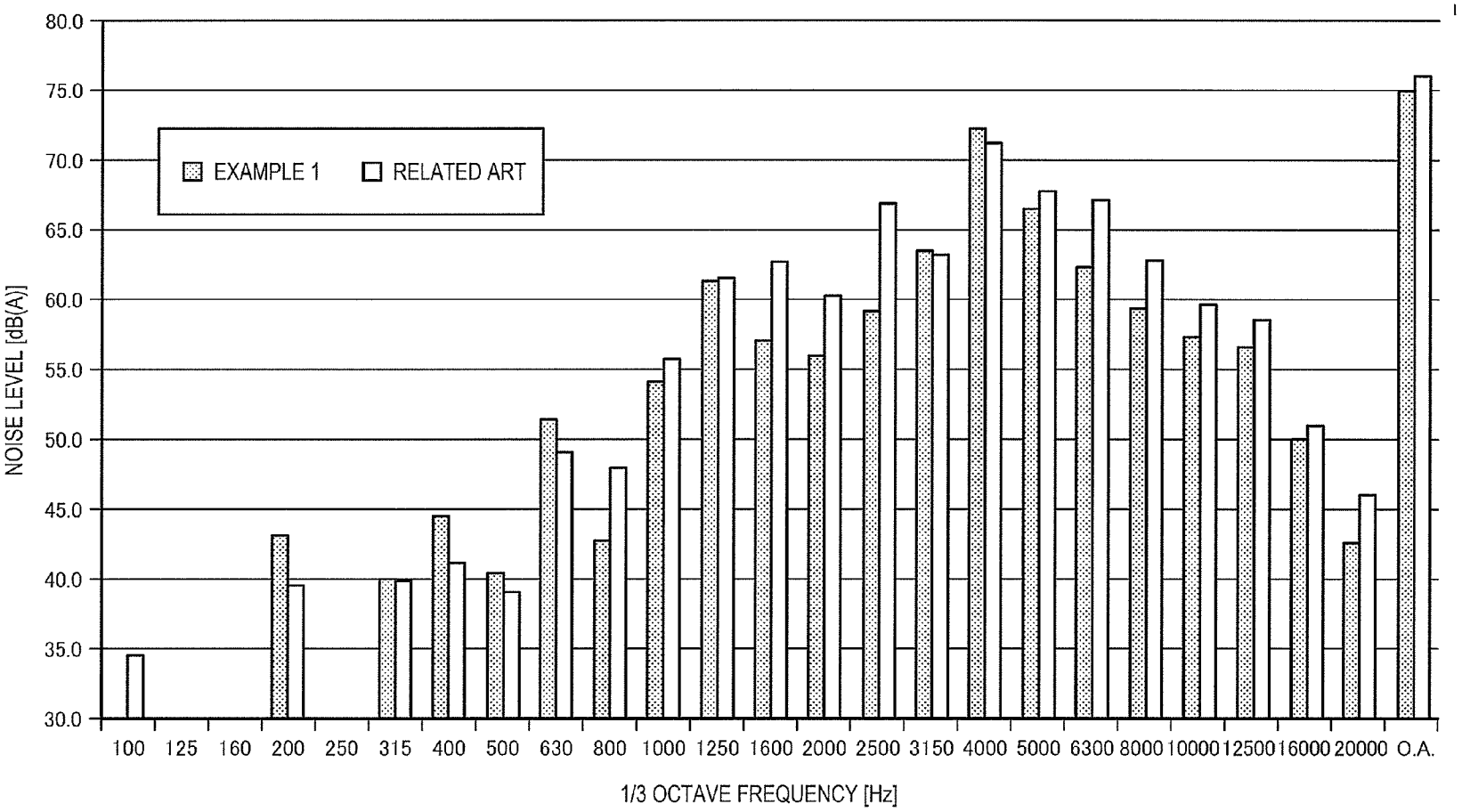
FIG. 5 is a graph in which noise of the rotary compressor using the upper end plate cover of Example 1 and noise of a rotary compressor of related art are compared.

FIG. 5 is a graph in which noise of the rotary compressor using the upper end plate cover of Example 1 and noise of a rotary compressor of related art are compared. FIG. 5 illustrates a noise level [dB(A)] (vertical axis) for each ⅓ octave frequency band measured through a band-pass filter of ⅓ octave as defined in JIS standard in a center frequency of 100 [Hz] to 20000 [Hz] (horizontal axis). A value of O.A. of the horizontal axis is a total value (overall value) that is obtained by summing the noise level for each ⅓ octave frequency band in an amount of energy. As illustrated in FIG. 5, the rotary compressor 1 of Example 1 could reduce the noise level more than the rotary compressor of the related art in ⅓ octave frequency of 800 Hz to 2500 Hz, 5000 Hz to 20000 Hz, and overall values.

EXAMPLE 2

Figure 6:
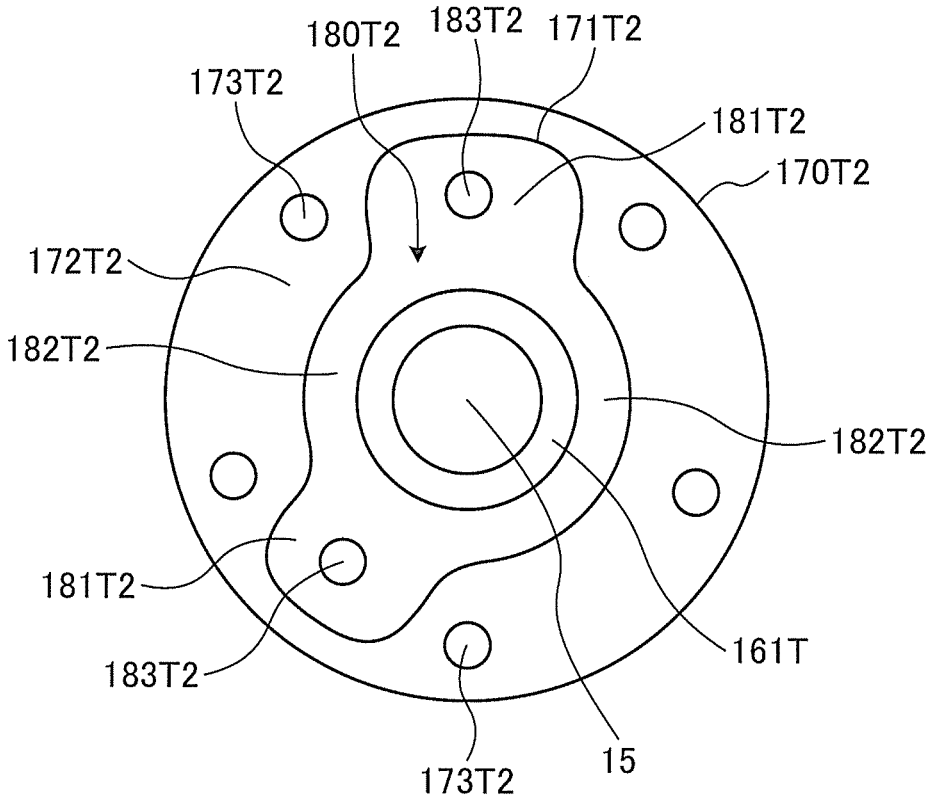
FIG. 6 is a plan view of an upper end plate cover of Example 2 when viewed from below.

FIG. 6 is a plan view of an upper end plate cover of Example 2 when viewed from below. As illustrated in FIG. 6, an upper end plate cover 170T2 of Example 2 is formed in a circular shape viewed in a plan view by press molding of steel plate and has a recessed portion 171T2 that is an outer shell of an upper muffler chamber 180T2. Five bolt holes 173T2 through which penetrating bolts 175 pass are disposed in a flat plate portion 172T2 configuring an outer edge of the upper end plate cover 170T2. The upper end plate cover 170T2, an upper end plate 160T, and a second cylinder 121T are fastened by five penetrating bolts.

The upper end plate cover 170T2 of Example 2 covers the upper ends of the second discharge valve unit 200TV and the refrigerant path hole 136 of the upper end plate 160T (see FIG. 4), and the upper muffler chamber 180T2 is formed between the upper end plate cover 170T2 and the upper end plate 160T. On a plane orthogonal to a rotation shaft 15, the upper muffler chamber 180T2 has two flared portions 181T2 which are radially flared between the penetrating bolts 175 (bolt holes 173T2) from the center of the rotation shaft 15; and five small-diameter portions 182T2, which connect between the flared portions 181T2 respectively, are apart from the penetrating bolts 175 so as not to interfere with the penetrating bolts 175 (bolt holes 173T2), and are formed on the center side of the rotation shaft 15 from the penetrating bolts 175.

A muffler outlet 183T2 is provided in each of the two flared portions 181T2. The muffler outlet 183T2 causes the upper muffler chamber 180T2 to communicate with the inside of the compressor housing 10.

The second outlet 190T (see FIG. 4) configuring a second discharge valve unit 200TV and the refrigerant path hole 136 (see FIG. 4) through which the lower muffler chamber (not illustrated) communicates with the upper muffler chamber 180T2 are opened toward the flared portion 181T2 of the upper muffler chamber 180T2. The second outlet 190T and the refrigerant path hole 136 are disposed in positions on sides which are opposite to each other with respect to the rotation shaft 15. Moreover, a total opening area of two muffler outlets 183T2 is equal to or less than a total opening area of the first and second outlets 190S and 190T so as to reduce the pressure pulsation of the discharge refrigerant by filling the upper muffler chamber 180T2 with the discharge refrigerant discharged from the first and second outlets 190S and 190T.

In the rotary compressor of Example 2, on the plane orthogonal to the rotation shaft 15, the upper muffler chamber 180T2 has a plurality (two) of flared portions 181T2 which are radially flared between the penetrating bolts 175 (bolt holes 173T2) from the center of the rotation shaft 15; and a plurality (two) of small-diameter portions 182T2, which connect between the flared portions 181T2 respectively, are apart from the penetrating bolts 175 so as not to interfere with the penetrating bolts 175 (bolt holes 173T2), and are formed on the center side of the rotation shaft 15 from the penetrating bolts 175. The muffler outlet 183T2 is provided in each of the plurality (two) of flared portions 181T2. The muffler outlet 183T2 is provided in each of the plurality (two) of flared portions 181T2. The second outlet 190T of the second discharge valve unit 200TV of the upper end plate 160T and the refrigerant path hole 136 which are opened on the inside of the upper muffler chamber 180T2 are disposed in the flared portions 181T2 on sides which are opposite to each other with respect to the rotation shaft 15. Therefore, the refrigerant discharged from the second outlet 190T is discharged from the muffler outlet 183T2 disposed on the second outlet 190T side to the inside of the compressor housing 10. The refrigerant discharged from the refrigerant path hole 136 is discharged from the muffler outlet 183T2 disposed on the refrigerant path hole 136 side to the inside of the compressor housing 10.

A length of the small-diameter portion 182T2 of Example 2 in a circumferential direction is longer than that of the small-diameter portions 182T of Example 1. Therefore, the refrigerant that is compressed by the second compressing unit 12T and the refrigerant having different pulsation component, which is compressed by the first compressing unit 12S, of which the pressure pulsation is reduced by the lower muffler chamber and the refrigerant path hole 136 are further unlikely to be merged on the inside of the upper muffler chamber 180T2 than the upper muffler chamber 180T of Example 1. The pressure pulsation of the refrigerant is unlikely to be amplified. Therefore, it is possible to suppress noise caused by the discharge of the refrigerant equal to or more greatly than the noise suppression effect in the rotary compressor 1 of Example 1 illustrated in FIG. 5.

EXAMPLE 3

Figure 7:
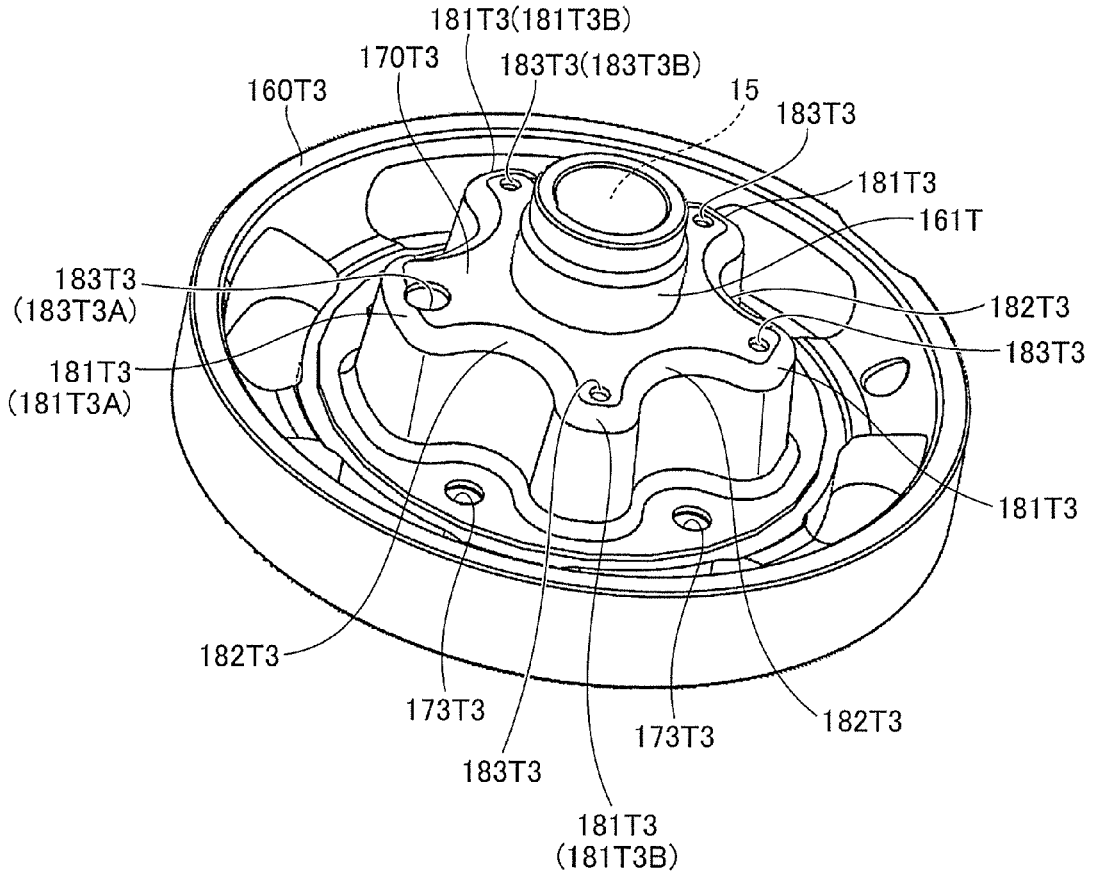
FIG. 7 is a perspective view illustrating an upper end plate cover of Example 3.
Figure 8:
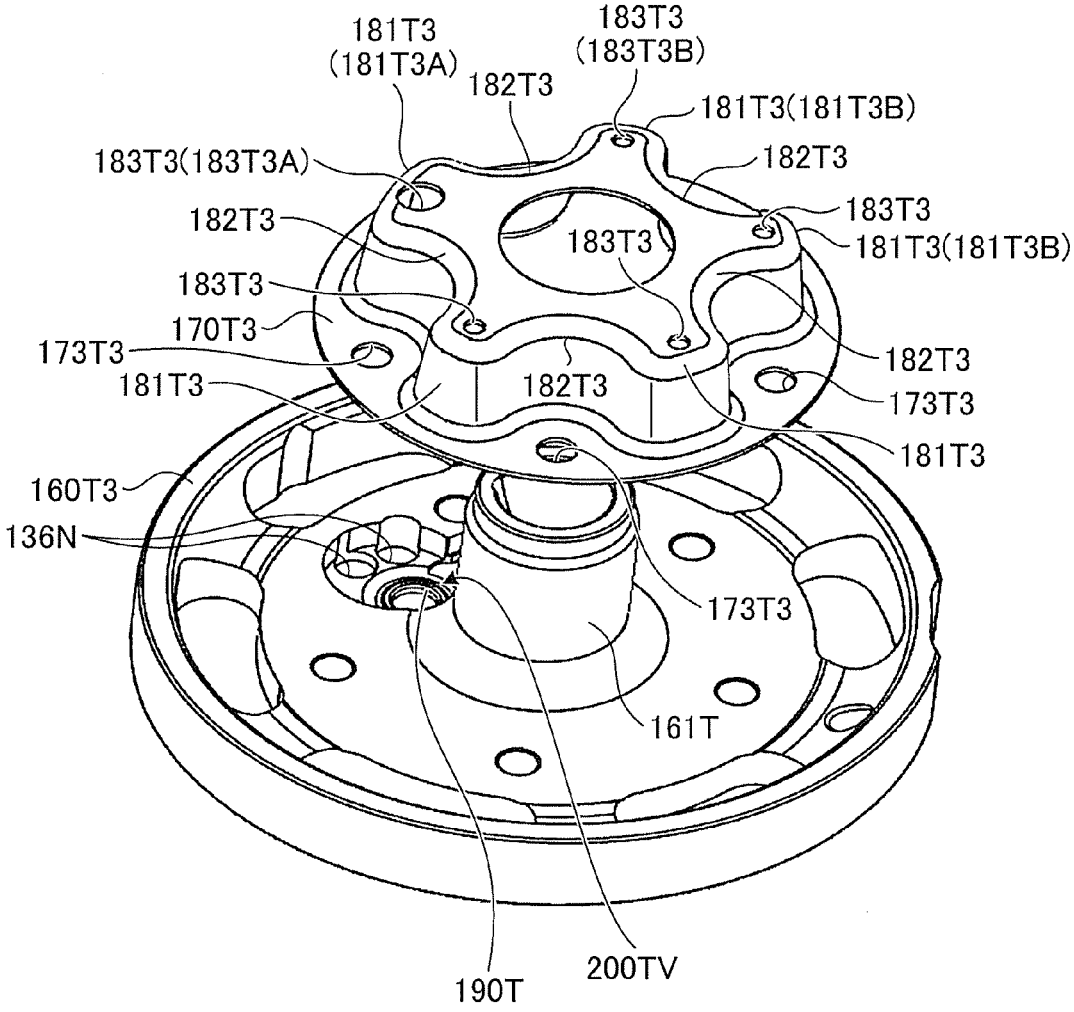
FIG. 8 is an exploded perspective view illustrating the upper end plate cover of Example 3.
Figure 9:
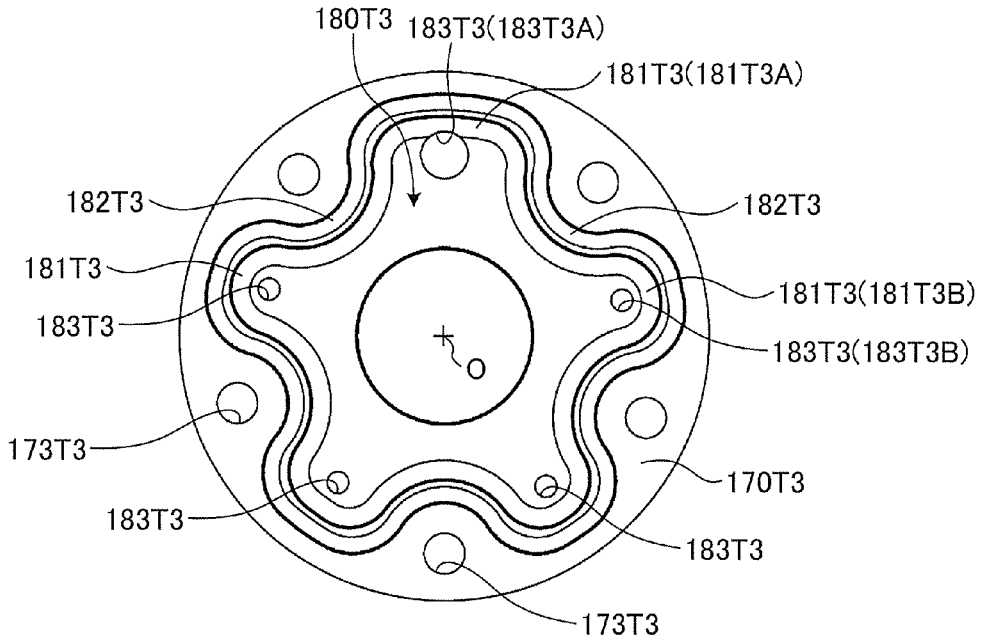
FIG. 9 is a plan view of the upper end plate cover of Example 3 when viewed from above.
Figure 10:
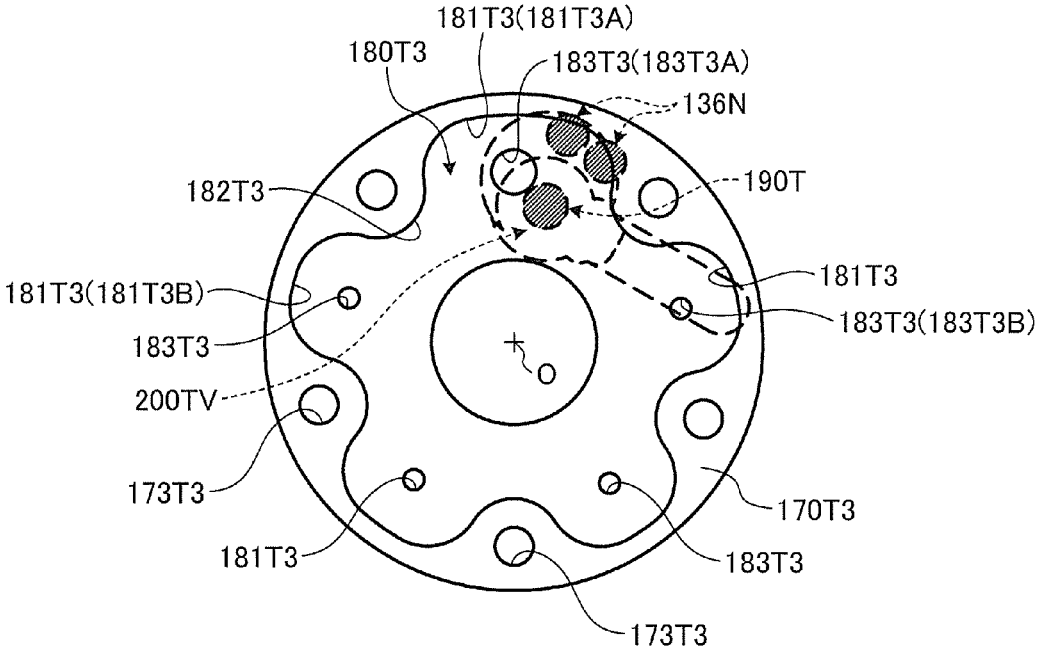
FIG. 10 is a plan view of a positional relationship between a muffler outlet of the upper end plate cover, a second outlet, and a refrigerant path hole of Example 3 when viewed from below the upper end plate cover.

FIG. 7 is a perspective view of an upper end plate cover of Example 3. FIG. 8 is an exploded perspective view illustrating the upper end plate cover of Example 3. FIG. 9 is a plan view of the upper end plate cover of Example 3 when viewed from above. FIG. 10 is a plan view of a positional relationship between a muffler outlet, a second outlet, and a refrigerant path hole of the upper end plate cover of Example 3 when viewed from below the upper end plate cover.

The rotary compressor of Example 3 includes, as illustrated in FIGS. 7 and 8, an upper end plate 160T3 closing an upper side of a second cylinder 121T and an upper end plate cover 170T3 forming an upper muffler chamber 180T3 between the upper end plate cover 170T3 and the upper end plate 160T3. In addition, the rotary compressor of Example 3 includes a second outlet 190T which is provided in the upper end plate 160T3 and communicates with the second compression chamber 133T, and a refrigerant path hole 136N (see FIGS. 1 and 8) passing through a lower end plate 160S, a first cylinder 121S, an intermediate partition plate 140, the upper end plate 160T3, and a second cylinder chamber 130T. In addition, the rotary compressor of Example 3 includes a plurality of bolt holes 173T3 which pass through the upper end plate cover 170T3 and are provided on a circle substantially concentric to the outer edge of the upper endplate cover 170T3; and the penetrating bolts 175 (see FIG. 1) which are inserted into the bolt holes 173T3 from the upper endplate cover 170T3 side and fasten the upper endplate cover 170T3 to the second cylinder 121T.

The upper end plate cover 170T3 has a muffler outlets 183T3 communicating with the inside of the compressor housing 10 and forms the upper muffler chamber 180T3 by covering openings of the second outlet 190T and the refrigerant path hole 136N of the upper end plate 160T3.

As illustrated in FIGS. 7, 8, and 9, on a plane orthogonal to the rotation shaft 15, the upper muffler chamber 180T3 of the upper end plate cover 170T3 has a plurality of flared portions 181T3 which are radially flared between the penetrating bolts 175 from the center O of the rotation shaft 15; and a plurality of small-diameter portions 182T3, which connect between the flared portions 181T3 respectively, are apart from the penetrating bolts 175 (bolt hole 173T3), and are formed on the center O side of the rotation shaft 15 from the penetrating bolts 175.

The muffler outlets 183T3 are respectively provided in the flared portions 181T3. The muffler outlets 183T3 are disposed in the vicinity of an inner wall of the upper endplate cover 170T3 on the outer periphery side on the inside of the flared portion 181T3.

On the plane orthogonal to the rotation shaft 15, the second outlet 190T and two refrigerant path holes 136N of the second discharge valve unit 200TV of the upper endplate 160T3 are positioned on an inside of one flared portion 181T3A of the plurality of flared portions 181T3. An opening area of the muffler outlet 183T3A (hereinafter, referred to as a main muffler outlet 183T3A) of one flared portion 181T3A is greater than an opening area of the muffler outlet 183T3B (hereinafter, referred to as a sub-muffler outlet 183T3B) of each of other flared portions 181T3B.

The main muffler outlet 183T3A is formed such that, for example, a diameter thereof is greater than a diameter of the sub-muffler outlet 183T3B substantially by two times. In addition, the diameter of the sub-muffler outlet 183T3B in Example 3 is formed smaller than the diameters of the muffler outlets 183T and 183T2 in Examples 1 and 2, for example, substantially by 25%. In addition, in each of Examples 1 to 3, for example, total opening areas of the muffler outlets 183T, 183T2, and 183T3 are set to be equal respectively.

In addition, the upper muffler chamber 180T3 in Example 3 has one main muffler outlet 183T3A and four sub-muffler outlets 183T3B, but the number of the sub-muffler outlets 183T3B is not limited to that in the example.

As illustrated in FIG. 10, two refrigerant path holes 136N are circular holes. On the plane orthogonal to the rotation shaft 15, the two refrigerant path holes 136N are disposed adjacent to each other on the outer periphery side of the upper endplate cover 170T3 with respect to the positions of the main muffler outlet 183T3A and the second outlet 190T. At least a part of each of the two refrigerant path holes 136N is stacked on the outside of an inner wall surface of one flared portion 181T3A and the two refrigerant path holes 136N are disposed in positions which open to the inside of the flared portion 181T3A. In addition, a total opening area of the two refrigerant path holes 136N is set to be equal to the opening area of the refrigerant path hole 136 of the rotary compressor 1 of Example 1. As described above, a size occupied by the refrigerant path hole 136N with respect to the rotation shaft (main-bearing unit 161T) in the radial direction is relatively reduced by being divided into the two refrigerant path holes 136N. Therefore, a radius from the center of the rotation shaft 15 to the outermost periphery of the refrigerant path hole 136N can be smaller than a radius from the center of the main-bearing unit 161T of the rotary compressor 1 of Example 1 to the outermost periphery of the refrigerant path hole 136. A space, in which the second discharge valve unit 200TV of the upper end plate 160T3 is disposed, can be reduced with respect to the upper end plate 160T3 in the radial direction. Moreover, the number of the refrigerant path holes 136N may be three or more.

As in Example 3, in a case of a configuration in which the refrigerant path holes 136N and the second outlet 190T are disposed in one flared portion 181T3 of the upper muffler chamber 180T3, a discharge amount of the discharge refrigerant intensively discharged to the inside of the one flared portion 181T3 is increased. Therefore, it is difficult to sufficiently discharge the discharge refrigerant from the muffler outlet 183T3 of the one flared portion 181T3. In the case of the configuration, the discharge refrigerant which is not discharged from the muffler outlet 183T3 among the discharge refrigerant discharged to the one flared portion 180T3 flows into another flared portion 181T3 and is discharged from each of the muffler outlets 183T3 of flared portions 181T3. However, since distances from the one flared portion 181T3 to the muffler outlets 183T3 of the other flared portions 181T3 are different respectively, frequency components of noise caused by the discharge of the refrigerant from the muffler outlets 183T3 of flared portions 181T3 are different from each other. Therefore, different frequency components of noise generated in each muffler outlet 183T3 are mixed and thereby there is a concern that it leads to a decrease in the effect of noise reduction.

Then, in Example 3, as described above, the opening area of the main muffler outlet 183T3A of the one flared portion 181T3A in which the refrigerant path holes 136N and the second outlet 190T are disposed is greater than the opening area of the sub-muffler outlet 183T3B of each of other flared portions 181T3B. Therefore, discharge property of the main muffler outlet 183T3A is properly raised and the discharge amount of the refrigerant from the sub-muffler outlet 183T3B of each of the other flared portions 181T3B is properly suppressed.

In addition, the opening area of the main muffler outlet 183T3A of the one flared portion 181T3A is equal to or greater than the opening area of the second outlet 190T of the upper end plate 160T3. Therefore, the discharge refrigerant discharged from the second outlet 190T and the refrigerant path holes 136N smoothly passes through the main muffler outlet 183T3A and is discharged to the inside of the compressor housing 10. Therefore, the flow rate of the discharge refrigerant flowing from the flared portion 181T3A to the sub-muffler outlets 183T3B of the other flared portions 181T3B is properly suppressed and the component of the pressure pulsation can be sufficiently reduced. Therefore, it is possible to further increase the effect of noise reduction.

In addition, the total opening area of the muffler outlets 183T3 (183T3A and 183T3B) provided in each of the plurality of flared portions 181T3 (181T3A and 181T3B) is equal to or less than the total opening area of each of the first outlet 190S of the lower end plate 160S and the second outlet 190T of the upper end plate 160T3. Therefore, it is possible to reduce the pressure pulsation of the discharge refrigerant by properly filling the inside of the upper muffler chamber 180T3 with the refrigerant discharged from the first and second outlets 190S and 190T to the inside of the upper muffler chamber 180T3.

Figure 11:
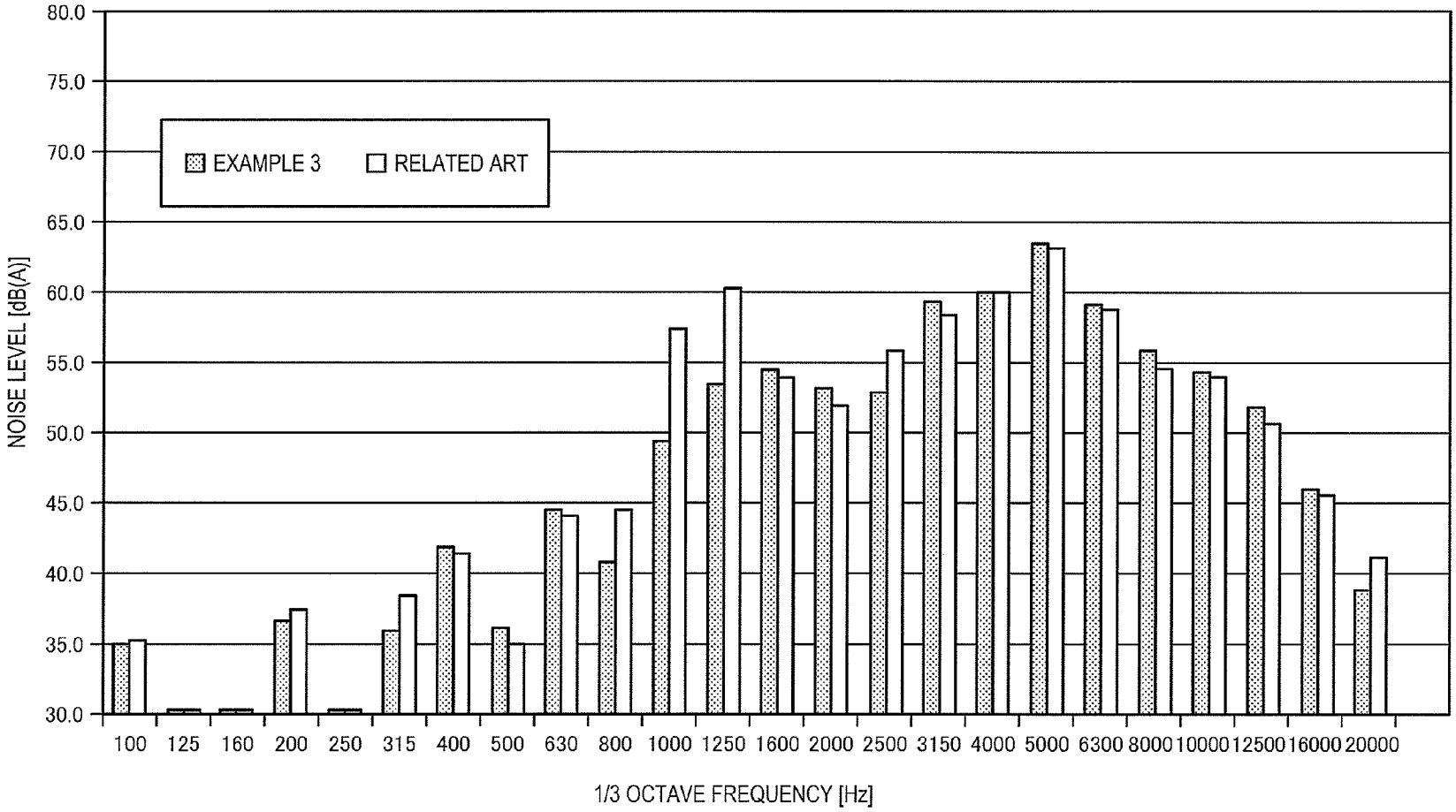
FIG. 11 is a graph in which noise of the rotary compressor using the upper end plate cover of Example 3 and noise of a rotary compressor of related art are compared.

FIG. 11 is a graph in which noise of the rotary compressor using the upper end plate cover 170T3 of Example 3 and noise of the rotary compressor of the related art are compared. In FIG. 11, a vertical axis indicates a noise level [dB (A)] and a horizontal axis indicates ⅓ octave frequency. As illustrated in FIG. 11, the noise level of the rotary compressor of Example 3 was smaller than the noise level of a rotary compressor of the related art in ⅓ octave frequency of a band of 800 Hz to 1250 Hz. Moreover, FIG. 11 illustrates a measured result that has been measured using a rotary compressor different from the rotary compressor of the related art in FIG. 5 as a rotary compressor of the related art.

As described above, according to Example 3, in a case where the second outlet 190T and the refrigerant path holes 136N of the upper end plate 160T3 are positioned in the one flared portion 181T3A among the plurality of flared portions 181T3 included in the upper muffler chamber 180T3, the opening area of the main muffler outlet 183T3A of the one flared portion 181T3A is greater than the opening area of the sub-muffler outlet 183T3B of each of the other flared portions 181T3B. Therefore, the refrigerant discharged to the flared portion 181T3A can be smoothly discharged from the main muffler outlet 183T3A and can also be properly discharged from each of the sub-muffler outlets 183T3B of the other flared portions. Therefore, in Example 3, it is possible to suppress noise caused by the discharge of the refrigerant from the upper muffler chamber 180T3.

Figure 12:
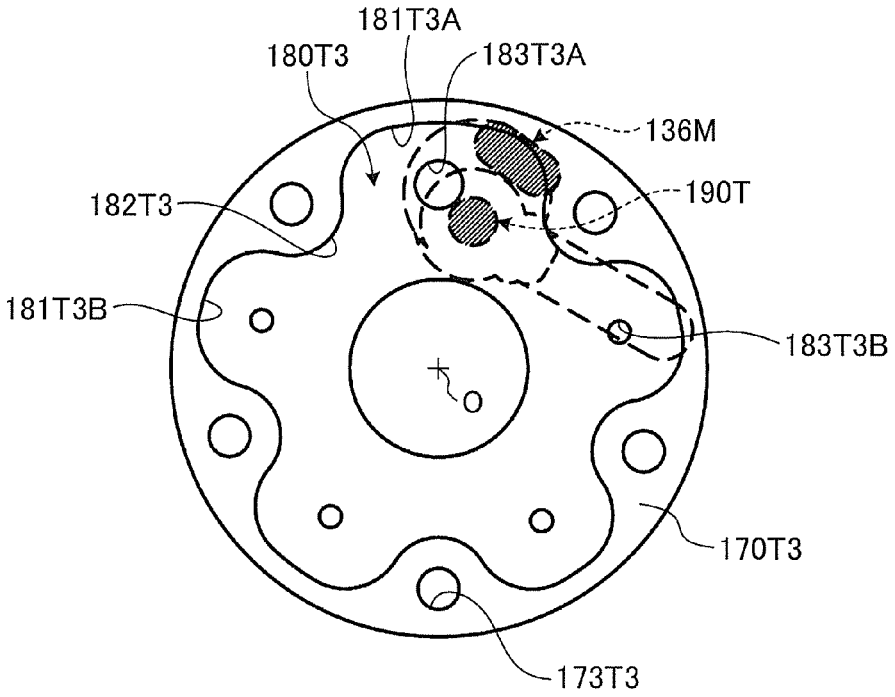
FIG. 12 is a plan view of an upper end plate cover of a modification example of Example 3 when viewed from below.
Figure 13:
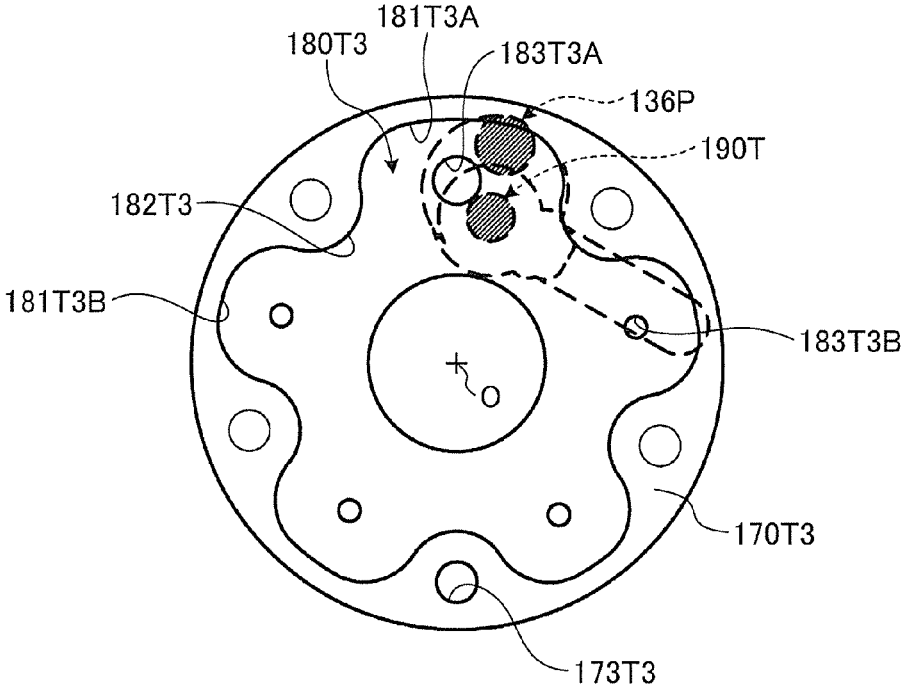
FIG. 13 is a plan view of an upper end plate cover of another modification example of Example 3 when viewed from below.

In Example 3 illustrated in FIG. 10, two refrigerant path holes 136N are provided, but the number and the opening shape of the refrigerant path holes are not limited to those in the example. FIG. 12 is a plan view of an upper end plate cover of a modification example of Example 3 when viewed from below. FIG. 13 is a plan view of an upper end plate cover of another modification example of Example 3 when viewed from below. In the modification examples of Example 3, the same reference numerals as those in Example 3 are given to the same configuration members as those in Example 3 and the description will be omitted.

As illustrated in FIG. 12, a long hole-shaped refrigerant path hole 136M is a long hole of which a long diameter is along a circumferential direction of a second outlet 190T. opening area of the refrigerant path hole 136M is set to be equal to an opening area of the refrigerant path hole 136 of the rotary compressor 1 of Example 1. Therefore, similar to Example 3, a radius from a center of a main-bearing unit 161T to the outermost periphery of the refrigerant path hole 136M can be made smaller than that of Example 1 and a space in which a second discharge valve unit 200TV of an upper end plate 160T3 is disposed can be reduced in a radial direction of the upper end plate 160T3. Moreover, also in Example 3, as illustrated in FIG. 13, a configuration having one refrigerant path hole 136P may be provided.

The examples have been described above, but the examples are not limited by the contents described above. In addition, those substantially identical, so-called equivalents are included in the constituent elements described above. Furthermore, the constituent elements described above can be appropriately combined. Furthermore, at least one of various omission, substitutions, and changes of the constituent elements can be performed without departing from the scope of the examples.

What is claimed is:

1. A rotary compressor comprising:

a vertically-positioned cylindrical compressor housing that is closed by providing a discharge unit of a refrigerant in an upper section thereof and providing an inlet unit of the refrigerant in a lower section thereof;

a compressing unit that is disposed in the lower section of the compressor housing and that compresses the refrigerant sucked in via the inlet unit and discharges the refrigerant from the discharge unit; and a motor that is disposed in the upper section of the compressor housing and drives the compressing unit;

wherein the compressing unit includes an annular first cylinder and a second cylinder, a lower end plate that closes a lower side of the first cylinder, an upper end plate that closes an upper side of the second cylinder, an intermediate partition plate that is disposed between the first cylinder and the second cylinder, and closes an upper side of the first cylinder and a lower side of the first cylinder, a rotation shaft that is rotated by the motor, a first eccentric portion and a second eccentric portion that are provided with a phase difference of 180 degrees from each other on the rotation shaft, a first piston that is fitted into the first eccentric portion, revolves along a first cylinder inner wall of the first cylinder, and forms a first cylinder chamber between the first piston and the first cylinder inner wall, a second piston that is fitted into the second eccentric portion, revolves along a second cylinder inner wall of the second cylinder, and forms a second cylinder chamber between the second piston and the second cylinder inner wall, a first vane that protrudes from a first vane groove provided in the first cylinder into the first cylinder chamber and abuts against the first piston, thereby partitioning the first cylinder chamber into a first inlet chamber and a first compression chamber, a second vane that protrudes from a second vane groove provided in the second cylinder into the second cylinder chamber and abuts against the second piston, thereby partitioning the second cylinder chamber into a second inlet chamber and a second compression chamber, a first outlet that is provided in the lower end plate and communicates with the first compression chamber, a second outlet that is provided in the upper end plate and communicates with the second compression chamber, a refrigerant path hole that passes through the lower end plate, the first cylinder, the intermediate partition plate, the upper end plate, and the second cylinder, an upper end plate cover that has a muffler outlet communicating with an inside of the compressor housing and forms an upper muffler chamber between the upper endplate cover and the upper end plate by covering the second outlet of the upper endplate and an upper end of the refrigerant path hole, a lower end plate cover that covers a discharge valve unit of the lower end plate and a lower end of the refrigerant path hole, a plurality of bolt holes that pass through the upper end plate cover and are provided on a circle substantially concentric to an outer edge of the upper end plate cover, and penetrating bolts that are inserted into the bolt holes from an upper end plate cover side and fasten the upper end plate cover to the second cylinder, wherein on a plane orthogonal to the rotation shaft, the upper muffler chamber has a plurality of flared portions that are flared from a center of the rotation shaft toward between the penetrating bolts and a plurality of small-diameter portions that connect between the flared portions, are apart from the penetrating bolts, and are formed on a center side of the rotation shaft from the penetrating bolts, wherein the muffler outlet is provided in each flared portion, and wherein the second outlet and the refrigerant path hole of the upper end plate are positioned on an inside of one of the plurality of flared portions, and an opening area of the muffler outlet of the one flared portion is greater than an opening area of the muffler outlet of each of the other flared portions.

2. The rotary compressor according to claim 1, wherein the opening area of the muffler outlet of the one flared portion is equal to or greater than an opening area of the second outlet of the upper end plate.

3. The rotary compressor according to claim 1, wherein a total opening area of the muffler outlet provided in each of the plurality of flared portions is equal to or less than a total opening area of each of the first outlet of the lower end plate and the second outlet of the upper end plate.

* * * * *